US010576003B2

(12) United States Patent
Britton

(10) Patent No.: US 10,576,003 B2
(45) Date of Patent: Mar. 3, 2020

(54) PERSONAL SUPPORT SLING, A MATTRESS SYSTEM INCLUDING SUCH SUPPORT SLING, OPTIONALLY WITH A WASTE ELIMINATION SYSTEM

(71) Applicant: Elaine L. Britton, Valhalla, NY (US)

(72) Inventor: Elaine L. Britton, Valhalla, NY (US)

( * ) Notice: Subject to any disclaimer, the term of this patent is extended or adjusted under 35 U.S.C. 154(b) by 651 days.

(21) Appl. No.: 15/228,479

(22) Filed: Aug. 4, 2016

(65) Prior Publication Data

US 2017/0027790 A1 Feb. 2, 2017

Related U.S. Application Data

(63) Continuation-in-part of application No. 14/330,006, filed on Jul. 14, 2014, now Pat. No. 9,545,348.

(51) Int. Cl.

| | |
|---|---|
| ***A61G 7/057*** | (2006.01) |
| ***A61G 7/065*** | (2006.01) |
| ***A61G 7/02*** | (2006.01) |
| ***A61G 7/00*** | (2006.01) |

(52) U.S. Cl.

CPC ..... *A61G 7/05723* (2013.01); *A61G 7/001* (2013.01); *A61G 7/02* (2013.01); *A61G 7/065* (2013.01)

(58) Field of Classification Search

CPC ..... A61G 7/02; A61G 7/057; A61G 7/1015; A61G 7/1019; A61G 7/109; A61G 9/003; A61G 7/003; A61G 7/008; A61G 7/018; Y10S 203/05

See application file for complete search history.

(56) References Cited

U.S. PATENT DOCUMENTS 2,774,079 A * 12/1956 Flatley ..... A61G 7/1019 108/147
3,011,820 A * 12/1961 Frieder ..... B66C 1/127 294/77
3,099,842 A * 8/1963 Jensen ..... A61G 7/1009 5/84.1
3,959,832 A * 6/1976 Parsons ..... A61G 1/04 5/84.1
4,222,133 A * 9/1980 Csatary ..... A61G 7/1046 4/450
4,620,333 A * 11/1986 Ritter ..... A61G 7/02 5/604
4,843,665 A * 7/1989 Cockel ..... A61G 7/0005 5/88.1
4,847,932 A * 7/1989 Baribault, Jr. ..... A61G 7/02 5/695

(Continued)

*Primary Examiner* — Nicholas F Polito
*Assistant Examiner* — Myles A Throop
(74) *Attorney, Agent, or Firm* — R. Neil Sudol; Henry D. Coleman

(57) ABSTRACT

A patient-support sling is at least partially disposable in a recessed area of the mattress, the sling being tiltably supported by a frame and carrying a waste receptacle. The sling has an aperture and at least one opening, the opening being larger in area than a bedsore. The sling is configured to enable selective relocation of the opening, thereby enabling an accommodation of bed sores for reducing incidence and severity thereof. The receptacle is removably attachable to the pelvic support member and disposable in part below the aperture for receiving eliminated waste of the user.

20 Claims, 14 Drawing Sheets

(56) References Cited

U.S. PATENT DOCUMENTS

| | | | | | |
|---|---|---|---|---|---|
| 5,265,296 | A * | 11/1993 | Abbas | A61G 7/02 | 5/488 |
| 5,399,132 | A * | 3/1995 | Bailey | A63B 5/11 | 160/135 |
| 5,729,849 | A * | 3/1998 | Garakani | A61G 7/015 | 5/604 |
| 6,295,666 | B1 * | 10/2001 | Takaura | A61G 7/001 | 5/611 |
| 9,545,348 | B2 * | 1/2017 | Britton | A61G 7/02 | |
| 2010/0101023 | A1 * | 4/2010 | Stephens | A61G 7/02 | 5/604 |
| 2014/0082841 | A1 * | 3/2014 | Wang | A47C 23/18 | 5/600 |

* cited by examiner

PERSONAL SUPPORT SLING, A MATTRESS SYSTEM INCLUDING SUCH SUPPORT SLING, OPTIONALLY WITH A WASTE ELIMINATION SYSTEM

CROSS-REFERENCE TO RELATED APPLICATION

This application is a continuation in part of application Ser. No. 14/330,006 filed Jul. 14, 2014.

BACKGROUND OF THE INVENTION

The present invention relates in part to a sling device for supporting a portion of a person. The sling may be used over a bed and is structured to reduce the incidence and severity of bedsores. The present invention is also directed to a mattress system incorporating the sling.

Currently, there are rotating mattresses on the market for approximately $4,000 to $30,000, but they do not provide for elimination of wastes. Medicaid currently requires nurses' aides in nursing homes to attend to 10 patients per shift. However, an incontinent patient with a severe waste problem may require 2 aides to rotate and clean them, using 2-5 towels, in addition to 1-4 sheets, and can take up to ½ hour. If all 10 patients require such attention, this would fill 5 hours of an aide's 8 hour shift. As a result, due to the physical effort of lifting heavy patients and the time involved, aides are not able to fully address the problem and many patients in nursing homes sit in their waste for up to 3-4 hours. Ultimately, the waste permeates and infects, or further exacerbates bedsores located near patients' lower spines. This common occurrence does not allow patients' bedsores to heal and is extremely inhumane.

Therefore, there is a need for a cost-effective mattress medical device that allows for ease of rotating a bedridden patient and effectuating the disposal of the patient's waste, to prevent and treat bedsores.

OBJECTS OF THE INVENTION

It is an object of the present invention to provide an improved patient support device that facilitates the reduction in incidence and amelioration of bedsores.

It is a further object of the present invention to provide such a patient support device that allows for waste disposal of bedridden patients.

Another object of the invention is to provide for a more cost effective, economically feasible rotation and waste disposal mattress system for bedridden patients for low-income nursing homes and in-home caretakers.

DEFINITIONS

The word "sling" is used herein to denote a flexible support device for supporting any portion of a patient's body. Typically, as described herein a sling is used as a pelvic support in conjunction with a bed or mattress. A pelvic sling preferably includes an aperture for placement of a patient waste receptacle such as a bag. The sling of the present invention could be used, however, as a shoulder support, to alleviate and reduce or eliminate bed sores at the upper back of the patient or user. In addition, the sling may be used not in conjunction with a bed or mattress but as a chair-type support and a sling for an appendage such as a leg that has injuries or surgical sites that heal more quickly if not subjected to pressure. A sling as specifically disclosed herein comprises a rectangular grid or matrix of tensile elements arranged to form rectangular openings in a rectangular array, whose size may be varied by shifting the elongate tensile elements orthogonally to their elongate dimensions. The sling of the present invention is thus customizable to accommodate the particular patient.

The word "platform" is used herein to denote a rigid support device for supporting any portion of a patient's body.

The terms "pelvic support member" and "personal support member" are generically used herein to cover both sling (flexible) and platform (rigid).

A "tilting mechanism" as that term is used herein denotes any kind of mechanical device that may be used to elevate one end or side of a sling or personal support member relative to another end or side. A tilting mechanism can be manual or automatic and can take any form suitable for the task, including electric linear servos, electric linear actuators, electric motors with rack-and-pinion or gear-and-pulley transmission trains, hydraulic or pneumatic lifts, etc. The tilting mechanism could be manually powered, for instance, with a crank and ratchet.

A "receptacle" is used herein to denote a container for human waste. The container typically takes the form of a bag but could be a rigid item such as a pot or bowl. A waste receptacle in accordance with the invention is typically attached to a pelvic support member an alignment with an aperture therein. Alternatively, particularly where a mattress is provided with a recess or cavity, the receptacle may be placed on the floor of the recess or cavity, but in vertical alignment with an aperture in a pelvic support member.

SUMMARY OF THE INVENTION

A flexible sling for partially supporting a person exemplarily over a mattress comprises a flexible frame including flexible two longitudinal edge elements extending parallel to a long axis of the sling and defining long edges of the sling. The flexible frame further includes two flexible transverse edge elements extending transversely to the long axis of the sling and defining short edges of the sling, each of the longitudinal edge elements being connected to each of the transverse edge elements. Plural flexible longitudinal inside elements are provided, each slidably connected at opposite ends to the transverse edge elements. Multiple flexible transverse inside elements are additionally included each slidably connected at opposite ends to the longitudinal edge elements. The longitudinal inside elements are spaced at variable distances from each other. Likewise, the transverse inside elements are spaced at variable distances from each other.

Where the transverse inside elements are primary transverse inside elements all having a first common length, the sling further comprises a plurality of secondary transverse inside elements having a second common length shorter than the first common length. Each of the secondary transverse inside elements is connected at one end to one of the longitudinal edge elements and at an opposite end to one of the longitudinal inside elements, thereby providing an aperture in the sling member.

Optionally, the longitudinal inside elements are primary longitudinal inside elements all having a third common length, while the sling further comprises a plurality of secondary longitudinal inside elements having a fourth common length shorter than the third common length. Each of the secondary longitudinal inside elements is connected at one end to one of the transverse edge elements and at an opposite end to one of the transverse inside elements at the aperture in the sling member. Preferably, however, the secondary longitudinal inside elements are omitted to enable a sideways adjustment in the location of the waste-elimination aperture.

The sling may further comprise a receptacle removably attachable to the sling and disposable in part below the aperture for receiving eliminated waste of the user.

A related user rotation and waste elimination system is utilizable with a mattress having a recessed area located at a user's pelvic region. The user rotation and waste elimination system is at least partially disposable in the recessed area of the mattress and comprises two posts (as a frame or in substitution for the frame), a tilting mechanism, a pelvic support member, and a receptacle. The two posts are positioned on the floor on each long side of the mattress near the recessed portion of the mattress. The pelvic support member is suspended between the two posts so as to be aligned with the mattress for support of the user's pelvic region. The pelvic support member has an aperture and at least one opening, the opening being larger in area than a bedsore. The pelvic support member is configured to enable selective relocation and size of the aperture and the opening, thereby enabling an accommodation of bed sores for reducing incidence and severity thereof. The posts incorporate a tilting mechanism which is operatively connected to the pelvic support member and configured to shift the pelvic support member so as to rotate or tilt the user's pelvic region. Additionally, the top portion of each post is slightly larger than its base to allow it to slide down over the base for transporting a patient off the bed. The receptacle is removably attachable to the pelvic support member and disposable in part below the aperture for receiving eliminated waste of the user.

Pursuant to further features of the present invention, the pelvic support member has a woven structure with weft elements and warp elements, at least some of the weft elements and warp elements being shiftable relative to others of the weft elements and warp elements to enable adjustment in location and size of at least one opening.

Optionally at least some of the weft elements and warp elements are shiftable relative to others of the weft elements and warp elements to enable adjustment in location and size of the aperture.

The tilting mechanism preferably includes a plurality of posts connected to the pelvic support member, at least one of the posts being movable alternately upwardly and downwardly so as to tilt the pelvic support member alternately to opposite sides of the system. The posts are preferably disposed on opposite long sides of the mattress, the pelvic support member being suspended over or in the recessed area of the mattress.

The tilting mechanism may be operatively connected to the pelvic support member so as to selectively tilt the pelvic support member and accordingly the user's pelvic region from side to side, about an axis parallel to a longitudinal axis of the mattress.

The receptacle may carry a plurality of fasteners for removably attaching the receptacle to the pelvic support member. These first fasteners may be supplemented by additional second fasteners, also located on the receptacle. The fasteners may consist of hook and Loop fasteners (VELCRO). The receptacle typically takes the form of a bag.

A method for managing human waste collection and disposal for a bed-ridden user comprises, in accordance with the present invention, providing a pelvic support member suspended at least in part over a mattress at a pelvic region of the user, the pelvic support member having an aperture, the pelvic support member having at least one additional opening, providing a bag dimensioned to fit the aperture, removably attaching the bag to the pelvic support member so that a pocket or receptacle portion of the bag is disposed below the aperture, and adjusting the pelvic support member to change a geometric parameter of the aperture and/or at least one opening, the geometric parameter being taken from the group consisting of (a) size of the aperture and at least one opening and (b) location thereof relative to edges of the pelvic support member.

Where the pelvic support member includes longitudinally extending flexible elongate elements each slidably attached to transverse edge elements of the pelvic support member and further includes transversely extending flexible elongate elements each slidably attached to longitudinal edge elements of the pelvic support member, the adjusting of the pelvic support member including sliding at least one of the flexible elongate elements along respective ones of the transverse edge elements and the longitudinal edge elements. Naturally the adjusting of the pelvic support member may include sliding a plurality of the flexible elongate elements along respective ones of the transverse edge elements and the longitudinal edge elements.

The attaching of the bag to the pelvic support member includes folding flanges or flaps of the bag over and around a portion of the pelvic support member so that terminal portions of the flanges or flaps are located below the pelvic support member, the attaching of the bag to the pelvic support member further including coupling first fasteners to second fasteners, both of which are located on the bag. The bag is removed from the pelvic support member upon a deposition of human waste into the receptacle portion of the bag, the removing of the bag including uncoupling the first fasteners from the second fasteners and unfolding the flanges or flaps from the portion of the pelvic support member.

A user support system comprises, in accordance with the present invention, two posts, a pelvic support member, and a tilting mechanism. The two posts are positioned on the floor on each long side of the mattress near the recessed portion of the mattress. The pelvic support member has an aperture and at least one opening and is suspended between the two posts so as to be aligned with the mattress for support of the user's pelvic region. The posts incorporate a tilting mechanism which is operatively connected to the pelvic support member and configured to rotate or tilt the user's pelvic region. Additionally, the top portion of each post is slightly larger than its base to allow it to slide down over the base for transporting a patient off the bed. The system may further comprise a receptacle removably attachable to the pelvic support member and disposable in part below the aperture for receiving eliminated waste of the user. The pelvic support member is configured for enabling a user to change a geometric parameter of the aperture and at least one opening taken from the group consisting of size of the aperture and opening and the location thereof relative to edges of the pelvic support member. The pelvic support member preferably includes longitudinally extending flexible elongate elements each slidably attached to transverse edge elements of the pelvic support member and further includes transversely extending flexible elongate elements each slidably attached to longitudinal edge elements of the pelvic support member.

BRIEF DESCRIPTION OF THE DRAWINGS

Other aspects, features, and advantages of the present invention will become more fully apparent from the following detailed description, the appended claims, and the accompanying drawings in which similar elements are given similar reference numerals.

DETAILED DESCRIPTION

Figure 1A:
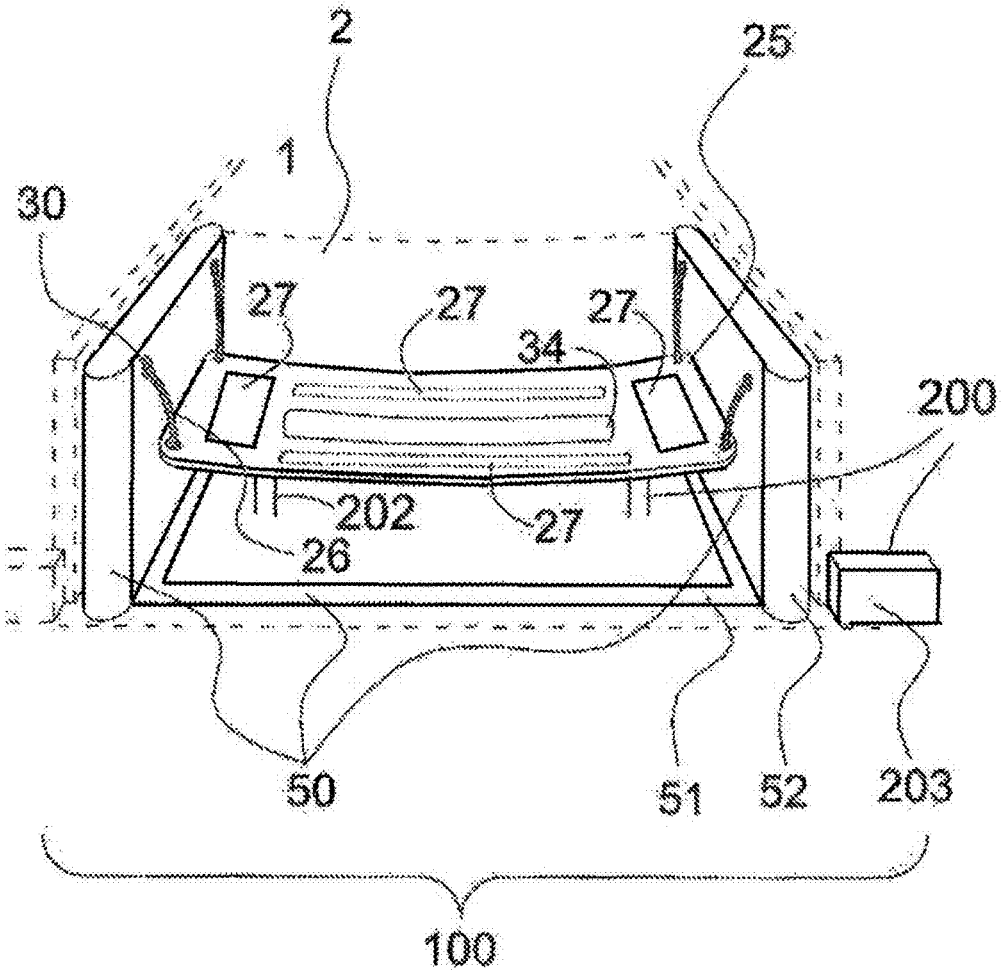
FIG. 1A is a perspective top view of the medical device showing the electronic lift system placed into the recess of the mattress.

As depicted in FIG. 1A, the rotating and waste elimination system 100 which is to be placed into a mattress 1 with a recessed area 2 comprises three parts: 1) a frame 50, 2) a user support member or platform 25 and 3) an electronic lift system 200.

The frame 50 has a rectangular base 51 that has four sides with the dimensions being approximately 36" long edges, 12" short edges, and has a central rectangular shaped cut out having two long edges of approximately 32 inches and two short edges of approximately 8 inches. Additionally, the frame 50 has two side walls 52 of approximately 24 inches height having an interior side, an exterior side, a top side, a bottom side, two lateral sides with the bottom side perpendicularly attached to the 12" shorter edges of the rectangular base 51.

The platform 25 has a top side, a bottom side forming a four-sided rectangular shape therein with a dimension that has approximately 36" longer sides, 12" shorter sides, and a central cut out 34 having two long sides of approximately 32 inches and two short sides of approximately 8 inches. The platform 25 is supported by two pairs of sliding posts 202 and is positioned parallel above the base 51 and between the two 24" side walls 52, having one end of optional two chains 26 attached to each of the 12" shorter sides through a chain hook and loop 30 on the corners and the other end of the optional two chains 26 attached to each interior sides of the walls 52 near the top side through another set of chain hook and loops 30. The platform 25 is lined with additional mini-alternating air mattresses 27 all connected to the main alternating air mattress 1. Additionally, the platform 25 has a plurality of fabric loops such as Velcro™ or similar styled material loops located on the bottom side.

Figure 1B:
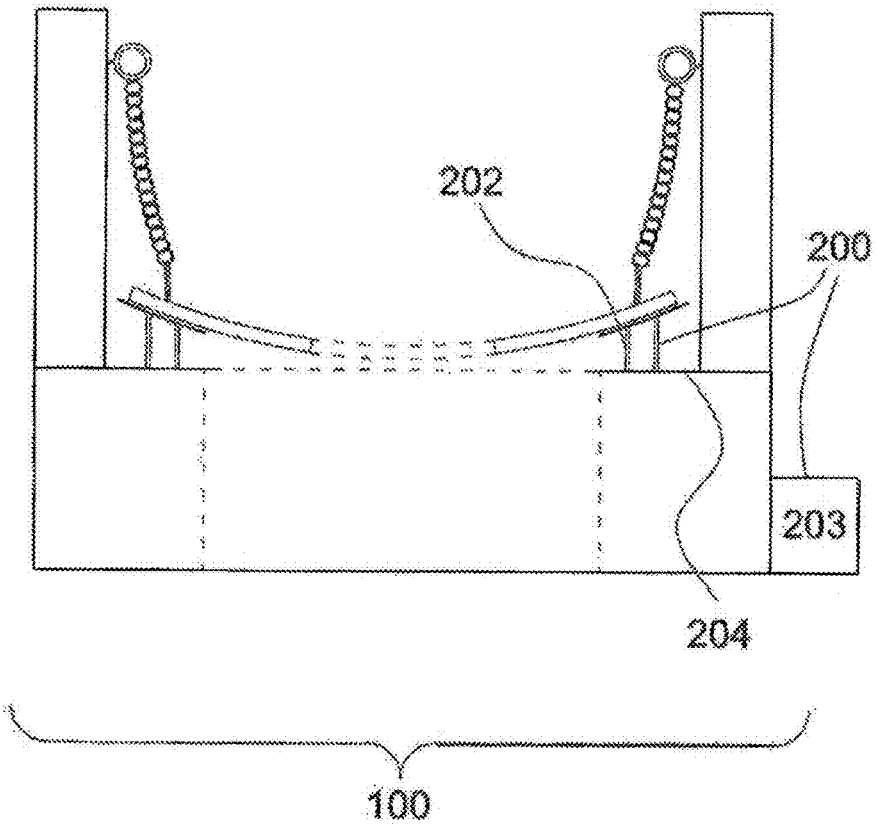
FIG. 1B and FIG. 1C are side views of the medical device showing the electronic lift system.
Figure 1C:
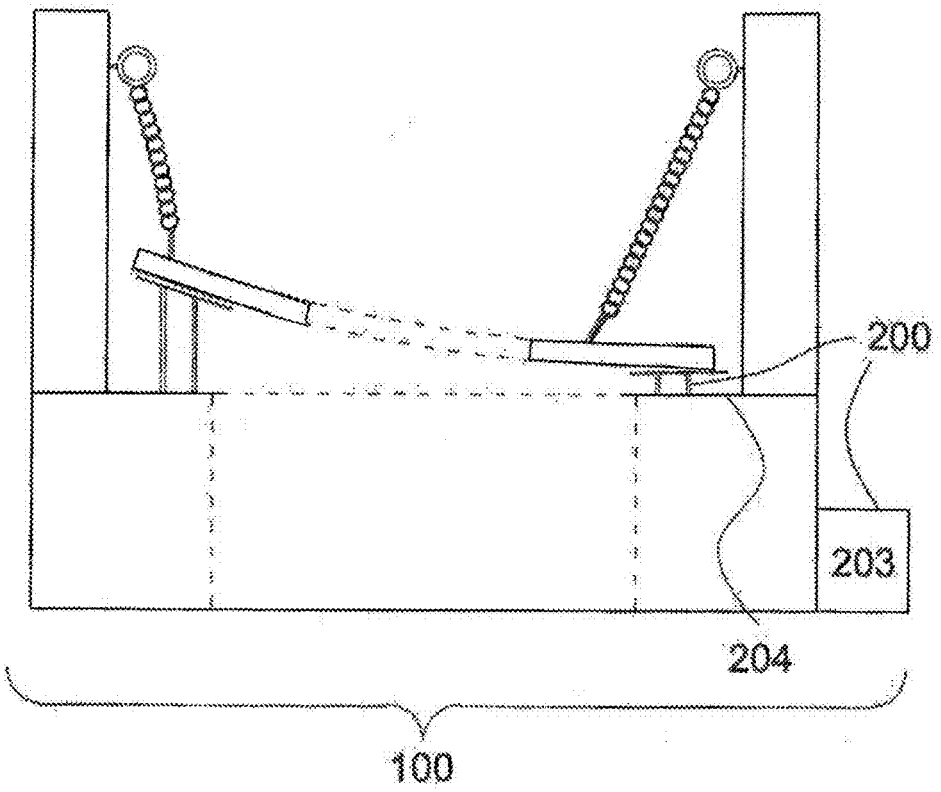

FIG. 1B and FIG. 1C show a side view of the rotating and waste elimination system 100.

An electronic lift system 200 seen in FIG. 1B and FIG. 1C supporting movement of the platform, comprising two pairs of posts 202, the top part of each individual post 202 is connected to the bottom of the platform and the bottom part of each post is connected to the top sides 204 of the rectangular base at approximately 10" distance from each of the short edges of the rectangular base 51 and platform 25, respectively; the lift system 200 has an programmable electronically-controlled gear 203 that operates the posts to cause one pair of posts to raise one end and simultaneously causes the second pair of posts to lower the opposite end of the platform to gently turn the patient. The electronic lift system 200 having programmed circuitry to determine how much force to apply and can be programmed as to how often to turn the patient. Chains are an optional security measure on the electronic lift system and may be placed on both sides of the platform and repositioned manually by chain hook and loops. However, they should not be taut to allow for automatic programmed turning.

The lift system 200 can also be a non-electronic lift system that is moved by a crankshaft known in the arts.

Figure 2:
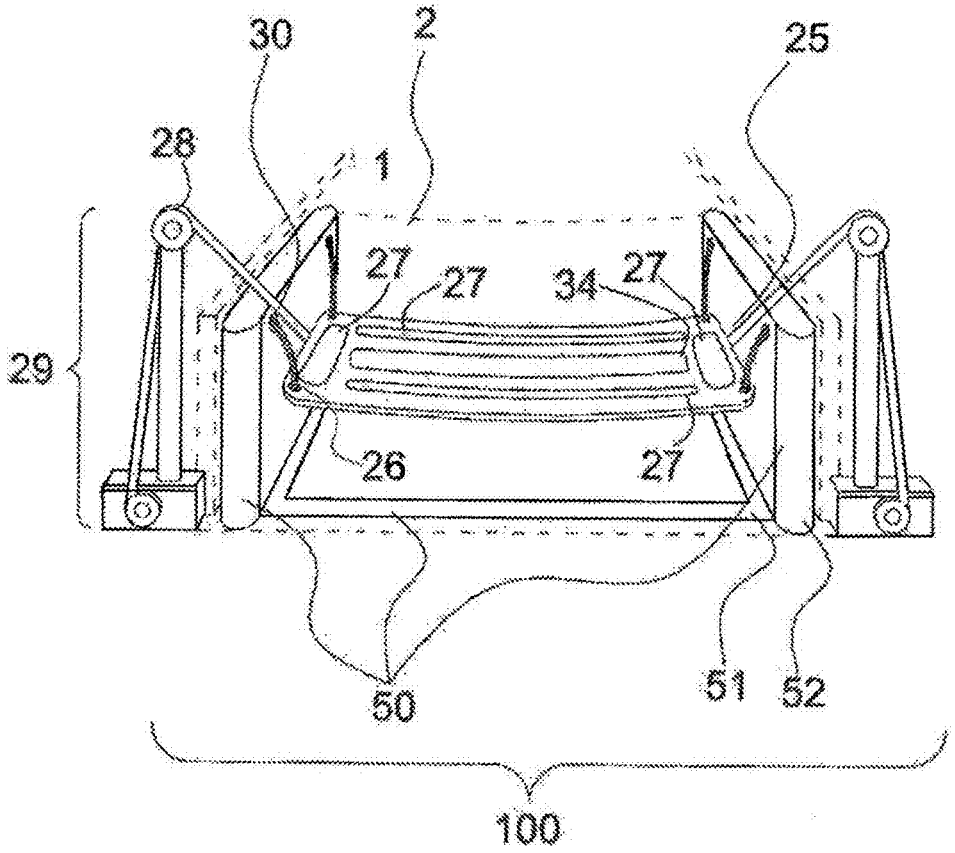
FIG. 2 is a perspective view of the medical device showing the two pulley systems.

FIG. 2 illustrates a perspective view of the rotating and waste elimination system 100. The rotating and waste elimination system 100 comprises three parts: 1) a frame 50, 2) a platform 25 and 3) two pulley systems.

The frame 50 has a rectangular base 51 that has four sides with the dimensions being approximately 36" long edges, 12" short edges, and has a central rectangular shaped cut out that has two long edges of approximately 32 inches and two short edges of approximately 8 inches. Additionally, the frame 50 has two side walls 52 of approximately 24 inches in height having an interior side, an exterior side, a top side, a bottom side, and two lateral sides with the bottom side perpendicularly attached to the 12" shorter edges of the rectangular base 51.

The platform 25 has a top side, a bottom side forming a four-sided rectangular shape with a dimension that has approximately 36" longer sides, 12" shorter sides, and a central cut out 34 having two long sides of approximately 32 inches and two short sides of approximately 8 inches. The platform 25 is positioned parallel above the base 51 and between the two 24" side walls 52, having one end of two chains 26 attached to each of the 12" shorter sides through a chain hook and loop 30 on the corners and the other end of the two chains 26 attached to each interior sides of the walls 52 near the top side through another set of chain hook and loops 30. The platform 25 is lined with additional mini-alternating air mattresses 27 all connected to the main alternating air mattress 1, the platform 25 having a plurality of fabric loops such as Velcro™ loops located on the bottom side.

An electronic pulley system 29 comprises a wheel on an axle that supports movement of a cable or belt 28 along its circumference. First end of the cable 28 is attached to the midpoint of each 12" shorter side of the platform 25 the second end of the cable 28 is attached to electronically controlled gears that rotate and counter-rotate to pull or release the cable 28 and in turn pull on or release the platform 25, the electronic pulley system 29 having programmed circuitry to determine how much force to apply and can be programmed as to how often to turn the patient. Said chains on both sides of the platform may be repositioned manually by chain hook and loops after the patient has been rotated to a new position to secure the patient. The chains are a security measure to prevent accidental falls and are not to be taut, so as to allow for automatic/programmed turning.

The pulley system can also be a non-electronic pulley system that is moved by a crankshaft known in the arts.

Figure 3:
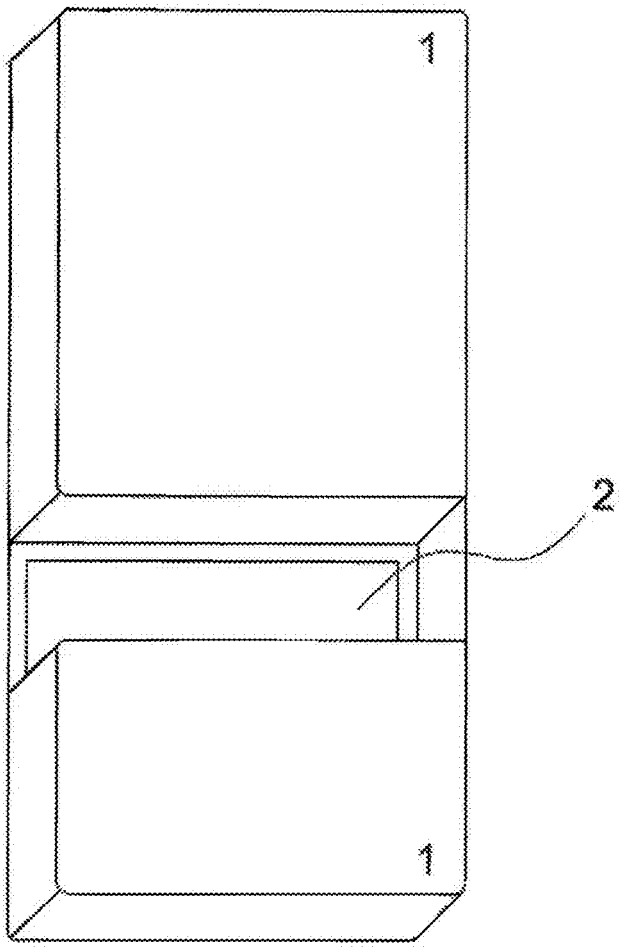
FIG. 3 is a top view of the mattress.
Figure 4:
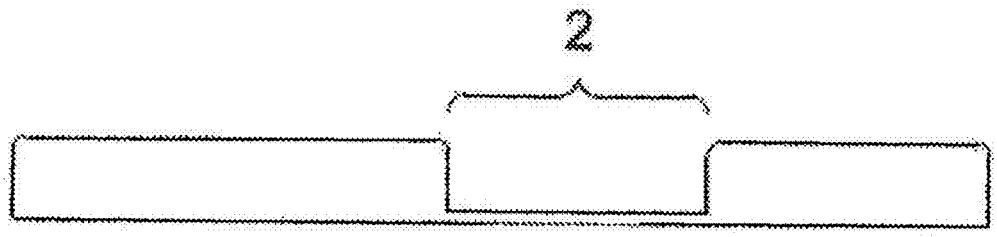
FIG. 4 is a side view of the mattress.
Figure 5:
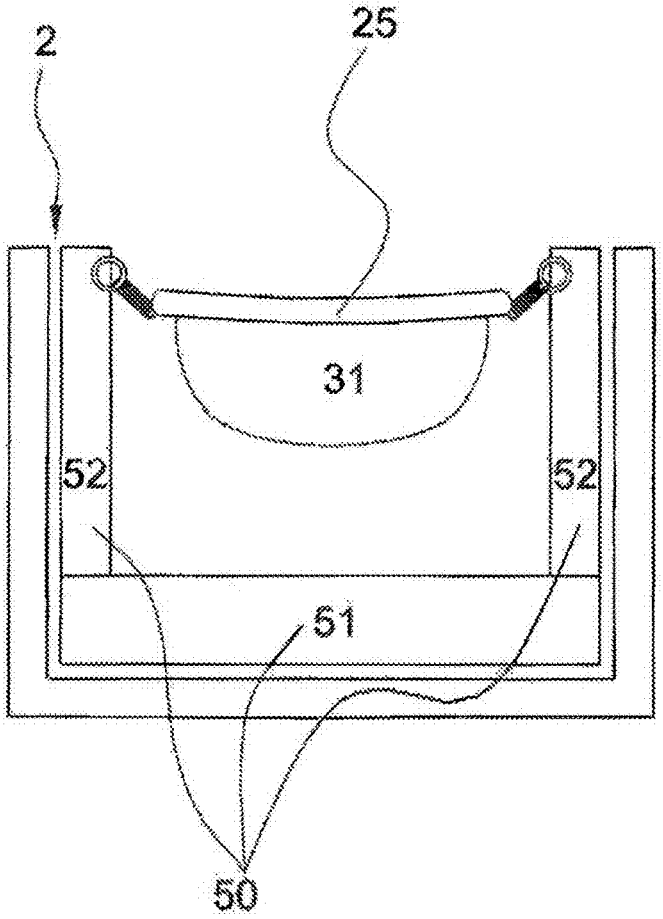
FIG. 5 is a side view of the frame and platform with plastic bag inserted for waste elimination, placed in the mattress's recess.

FIGS. 3 and 4 are a top view and a side view of the mattress 1 with a recessed area 2 for receiving the frame 50 and the platform 25. FIG. 5 is a side view of the platform 25, frame 50 and plastic bag 31 for waste elimination placed in the mattress's recess 2.

Figure 6:
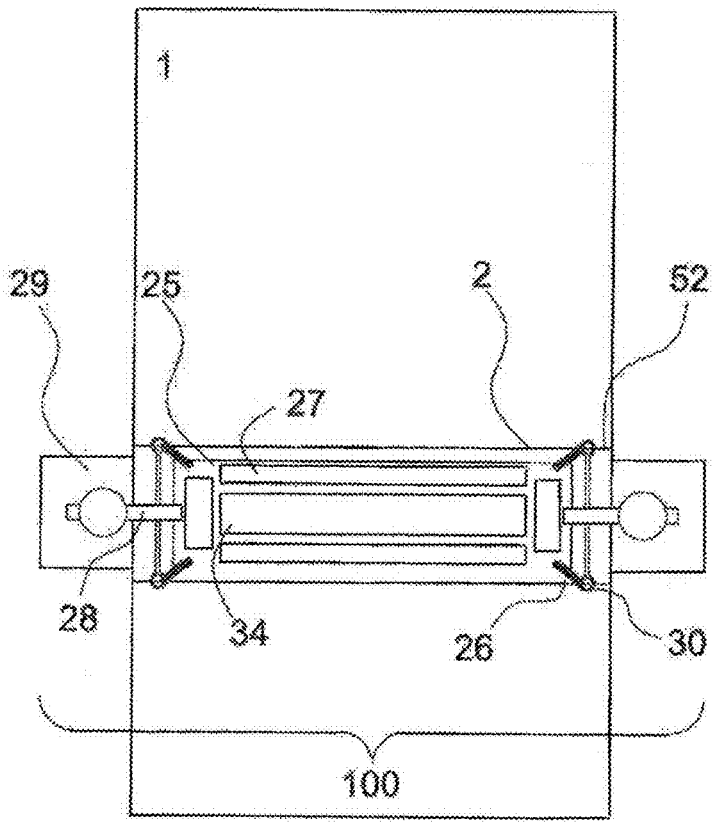
FIG. 6 is a top view of the medical device with the two pulley systems placed into the recess of the mattress.

FIG. 6 discloses a top view of the mattress with a Rotation/Waste Elimination System 100 with the frame 50 and the platform 25 placed into the recess 2 of the mattress 1. When the frame 50 and platform 25 are placed within the recessed area 2, there is a continuous surface from the mattress 1 to the mini mattresses 27 on the platform.

In one embodiment, the mattress 1 is an alternating pressure mattress known in the art. An alternating pressure mattress comprising a plurality of inflatable side formations, located on both sides of the mattress, which can be inflated and deflated cyclically in a predetermined sequence. In a second embodiment, the mattress is a regular mattress with a recess area with the mini-mattresses made of similar material or foam.

In the first and second embodiment, the electronic lift system or electronic pulley system rotates the lower half of the patient; the upper body may or may not have to be moved manually as determined by the degree of rotation. This allows for a more cost effective/economically feasible rotation/waste disposal system for lower-income nursing homes and caretakers in-home.

In a third embodiment the mattress is a lateral rotation therapy mattress with a hole around the patient's pelvic area for waste disposal. The lateral rotation therapy mattress is known in the art. (See U.S. Pat. No. 5,375,273, "Lateral rotation therapy mattress system and method", publication date Dec. 27, 1994, the disclosure of which is incorporated herein by reference). The lateral rotation therapy mattress includes: a plurality of side-by-side longitudinal air cells; and apparatus to supply pressurized air to the air cells to control the levels of pressure in individual ones of and/or groups of the air cells. The lateral rotation therapy mattress may have air cells divided into four groups: 1) left outer, 2) left inner, 3) right inner, and 4) right outer. Each air cell may be constructed of any suitable material such as compliant vinyl or urethane infused Nylon material. As an example, a patient may be laterally rotated about 30-45 degrees to the right by reducing the pressure in the right inner cells and increasing the pressure in the left inner cells. When it is desired to rotate the patient back to a supine position, the pressure in the right inner air cells are increased while the pressure in the left inner air cells are decreased until the pressure of both the right inner air cells and the left inner air cells are the same. When it is desired to rotate the patient to the left, the pressure in the right inner air cells are increased while the pressure in the left inner air cells are decreased. The rate of rotation is very slow and gentle so as not to wake the patient. The pressure control system for air support structure includes an air blower which supplies pressurized air to a main manifold which, in turn, provides air to air cells through a pressure regulator.

Figure 7:
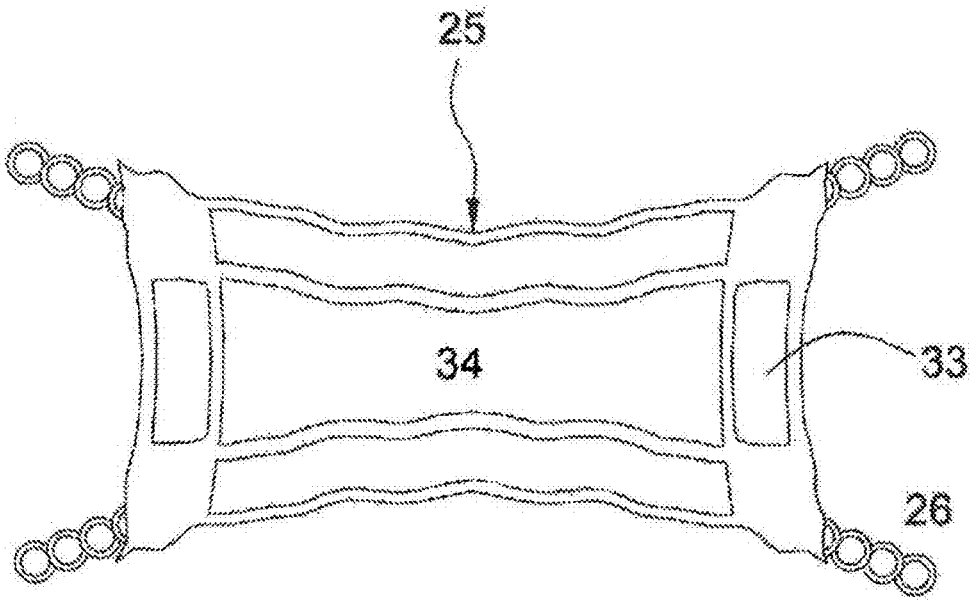
FIG. 7 is a bottom view of the platform showing fabric loops attached to each of the 4 sides and the cut-out portion of the platform, in which the waste collecting plastic bag will be placed.

With reference to FIG. 7, there is shown the bottom view of the platform 25 showing fabric loops 33 attached to each of the bottom 4 sides and the cut-out portion of the platform 34, in which the waste collecting plastic bag 31 will be placed.

Figure 8:
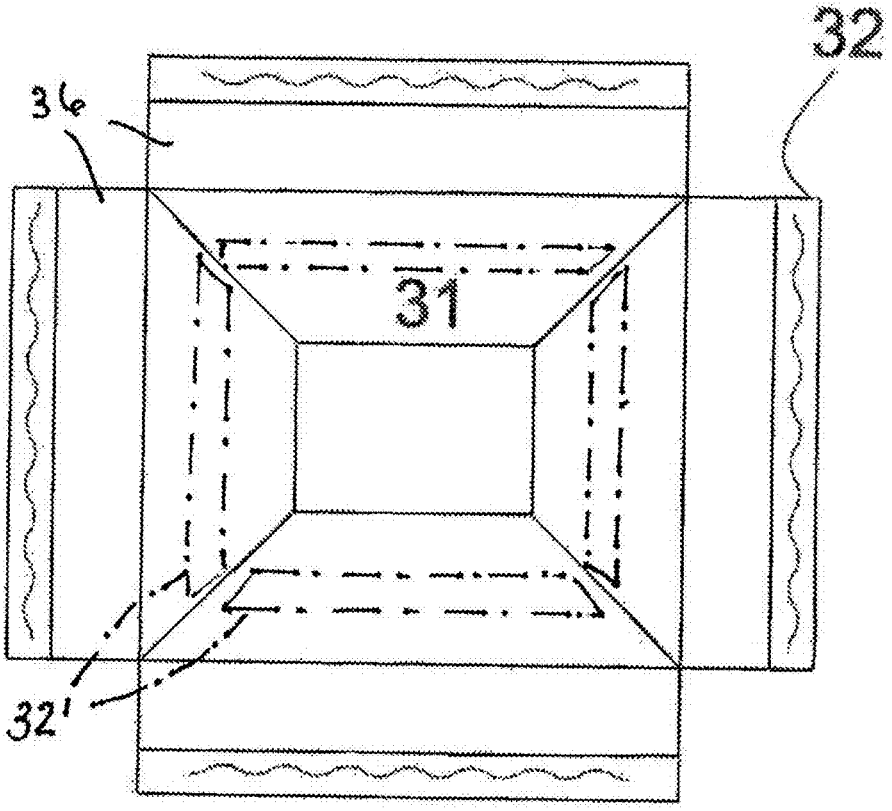
FIG. 8 is a perspective of the one-time use waste collecting plastic bag.

FIG. 8 shows the one-time use waste collecting plastic bag having dimensions which should be an exact fit to the interior cut out 34 portion of the platform 25, with each corner cut down approximately 4" (or more) at the crease to separate the sides, fabric hooks 32 are located on the top 2" of the outside of each side of the plastic bag 31, the plastic bag 31 is inserted into the interior cut out 34 portion of the platform 25 with the plastic bag 31 sides folded over the mini air mattresses 27 and then having the top 2" of the outside of each side of the plastic bag 31 folded underneath so the fabric hooks 32 on the plastic bag 31 can engage with the fabric loops 33 located on the bottom of the platform 25. The one-time use waste collecting plastic bag 31 is inexpensive to manufacture and cost effective. The waste collecting plastic bag 31 can be easily removed and disposed by detaching its fabric hook from the fabric loop located on the bottom of the platform. In an alternative design, the bag 31 may be provided with both fabric hooks 32 and fabric loop elements 32'. Fabric hook elements 32 are positioned along the end of flaps or flanges 36, while fabric loop elements 32' are positioned at spaced locations on the outside center of the bag 31.

The attaching of the bag 31 to a pelvic support member includes folding flanges or flaps 36 over and around a portion of the pelvic support member so that terminal portions of the flanges or flaps are located below the pelvic support member and so that the fabric hook elements 32 are aligned with and overlap the fabric loop elements 32'. The attaching of the bag 31 to the pelvic support member further includes coupling hook and loop fasteners 32 and 32' to one another. Bag 31 is removed from the pelvic support member upon a deposition of human waste into the receptacle portion of the bag, the removing of the bag including uncoupling hook and loop fasteners 32 and 32' from one another and unfolding the flanges or flaps 36 from the portion of the pelvic support member.

Figure 9:
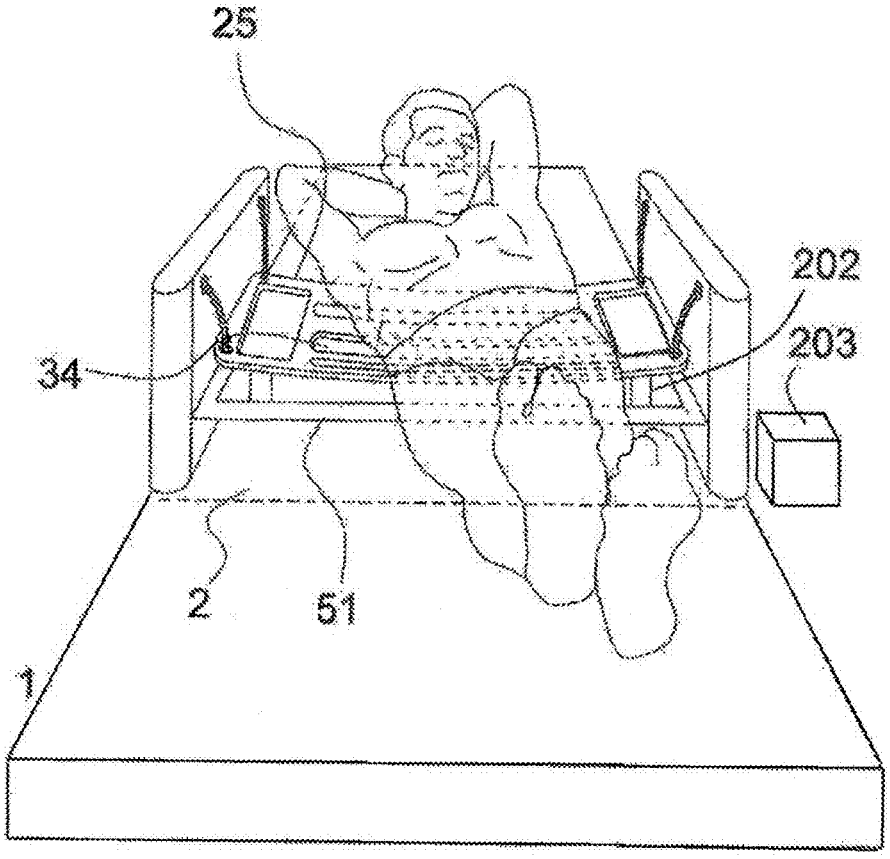
FIG. 9 is a perspective view showing the platform and electronic lift system with the patient tilted between 30 degrees to 40 degrees.

FIG. 9 shows the platform and patient tilted between 30 degrees to 40 degrees. A method for ease of rotation and waste disposal for bedridden patients to prevent and treat bedsores comprises steps of: (a) providing a mattress with a rotation/waste elimination system around the pelvic area of a patient. The mattress mentioned here is the mattress described earlier; (b) an electronic lift system supported by two pairs of sliding posts which raise one end and simultaneously lowers the opposite end of the platform to the right (or left) and turns the patient's body towards the left (or right); (c) if chains are used, manually repositioning the chain hook and loop to ensure the patient is secure, but confirming they are not taut to allow for automatic programmed turning; and (d) if necessary, manually turning the patient's upper body towards the left (or right).

Figure 10:
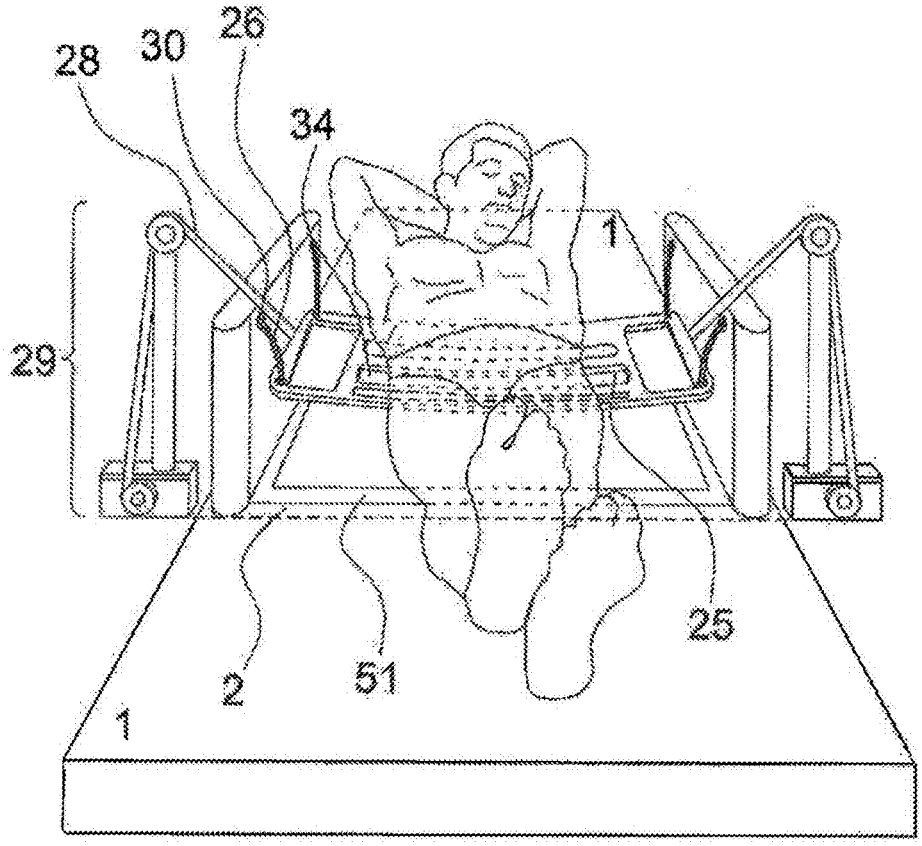
FIG. 10 is a perspective view showing the platform and two pulley systems with the patient tilted between 30 degrees to 40 degrees.

FIG. 10 shows the platform and patient tilted between 30 degrees to 40 degrees. A method for ease of rotation and waste disposal for bedridden patients to prevent and treat bedsores comprises steps of: (a) providing a mattress with a rotation/waste elimination system around the pelvic area of a patient.

The mattress mentioned here is the mattress described earlier; (b) an electronic pulley system to pull the right cable (or left cable), in turn pulling the right (or left) side of the platform up to the right (or left) and turning the patient's body towards the left (or right); (c) manually repositioning the chains' hooks and loops to ensure the patient is secure, but confirming the chains are not taut to allow for automatic programmed turning; and (d) if necessary, manually turning the patient's upper body towards the left (or right).

Figure 11:
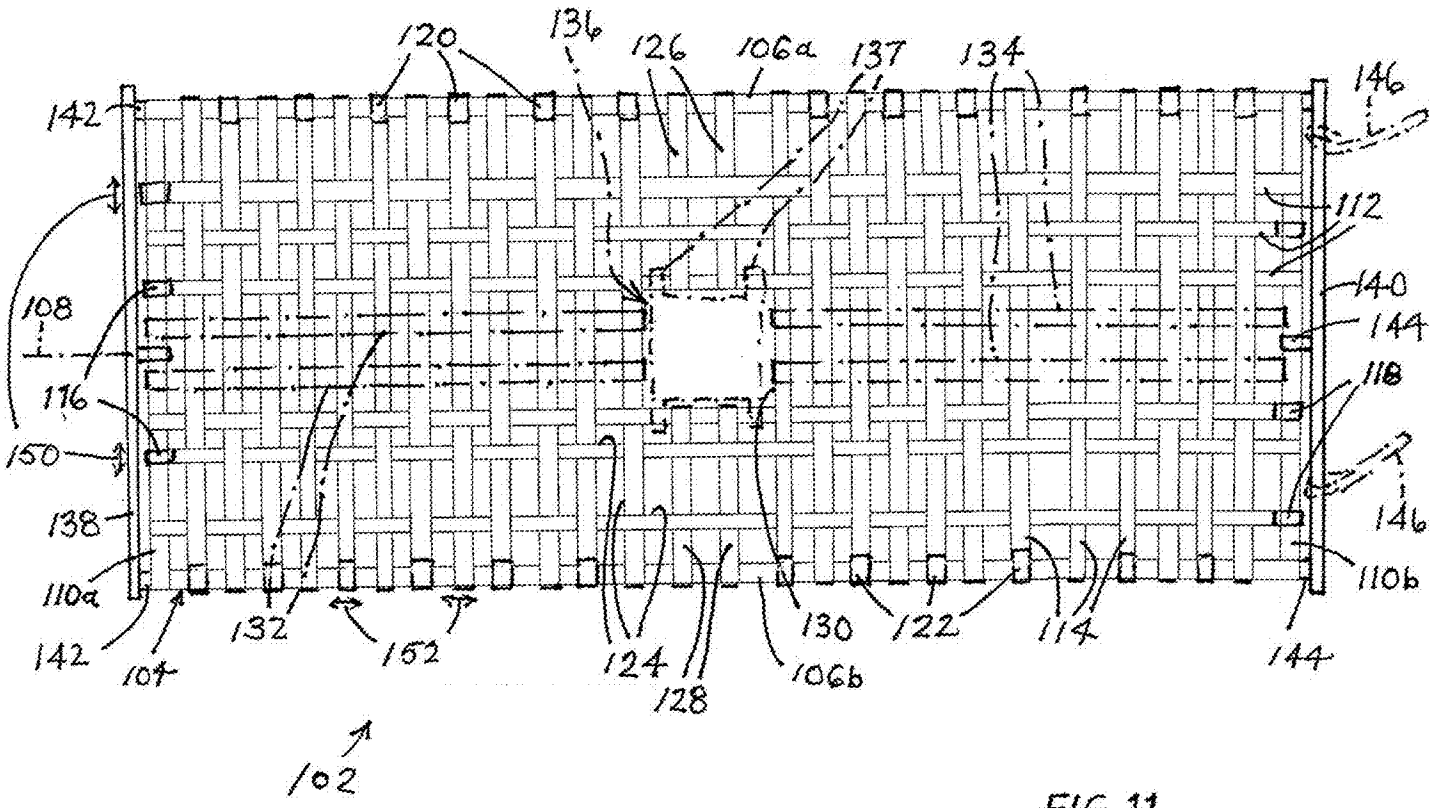
FIG. 11 is a top plan view of a sling utilizable as a patient or pelvic support member in the personal medical support system of device of FIGS. 1A-1C, 2, 9, and 10.

As depicted in FIG. 11, a personal support member or specifically a pelvic support member 102 in the form of a flexible sling utilizable in substitution for platform 25 described above comprises a flexible frame 104 including flexible two longitudinal edge elements 106*a* and 106*b* extending parallel to a long axis 108 of the sling and defining long edges thereof. Frame 104 further includes two flexible transverse edge elements 110*a* and 110*b* extending transversely to the long axis 108 of the sling and defining short edges thereof, each of the longitudinal edge elements 106*a* and 106*b* being connected to each of the transverse edge elements 110*a* and 110*b*. Plural flexible longitudinal inside elements 112 are provided each slidably connected at opposite ends to the transverse edge elements 110*a* and 100*b*, while multiple flexible transverse inside elements 114 are additionally included each slidably connected at opposite ends to the longitudinal edge elements 106*a* and 106*b*. More particularly, longitudinal inside elements 112 are provided with terminal loops 116 and 118 that extend around transverse edge elements 110*a* and 110*b*. Transverse inside elements 114 are similarly formed with terminal loops 120 and 122 that extend around longitudinal edge elements 106*a* and 106*b*. Transverse edge elements 110*a* and 110*b* traverse loops 116 and 118, while longitudinal edge elements 106*a* and 106*b* traverse loops 120 and 122. Owing to the slidable fastening of longitudinal inside elements 112 to transverse edge elements 110*a* and 110*b*, indicated by double-headed arrows 150, the longitudinal inside elements are spaced at variable distances from each other. Likewise, owing to the slidable fastening of transverse inside elements 114 to longitudinal edge elements 106*a* and 106*b*, indicated by double-headed arrows 152, the transverse inside elements are spaced at variable distances from each other.

Longitudinal edge elements 106*a* and 106*b*, transverse edge elements 110*a* and 110*b*, as well as longitudinal inside elements 112 and transverse inside elements 114, are all preferably made of a fabric material. Terminal loops 116, 118, 120, 122 are formed by folding back end portions of longitudinal inside elements 112 and transverse inside elements 114 and stitching the folded-over ends to the respective inside elements.

Longitudinal inside elements 112 and transverse inside elements 114 collectively define a typically irregular rectangular array of rectangular openings 124 that may be individually enlarged, by the sliding of transverse inside elements 114 along longitudinal edge elements 106*a* and 106*b* and by the sliding of longitudinal inside elements 112 along transverse edge elements 110*a* and 110*b*, to generate openings at selected locations of sufficient size to accommodate bedsores of a bedridden person, so that the bedsores are free of engagement with the supporting elements 112 and 114 and thereby are free of compressive pressure, thereby allowing adequate blood circulation and air contact for drying and healing.

Where transverse inside elements 114 are primary transverse inside elements all having a first common length L1, the sling 102 may further comprise a plurality of secondary transverse inside elements 126 and 128 having a second common length L2 shorter than the length L1 of the primary transverse elements 114. Each of the secondary transverse inside elements 126, 128 is connected at one end to one of the longitudinal edge elements 106*a* or 106*b* and at an opposite end to one of the longitudinal inside elements 112, thereby providing an aperture 130 in the sling member.

Optionally, longitudinal inside elements 112 are primary longitudinal inside elements all having a third common length L3, while the sling further comprises a plurality of secondary longitudinal inside elements 132 and 134 having a fourth common length L4 shorter than length L3. Each secondary longitudinal inside element 132 and 134 is connected at one end to one of the transverse edge elements 110*a* or 110*b* and at an opposite end to one of the transverse inside elements 114 at the aperture 130 in the sling member. Preferably, however, the secondary longitudinal inside elements are omitted to enable a sideways adjustment in the location of the waste-elimination aperture.

Sling 102 may further comprise a receptacle 136, e.g., plastic bag, removably attachable to the sling and disposable in part below the aperture for receiving eliminated waste of the user. The removal attachment of receptacle 136 to sling 102 at aperture 130 may be implemented as discussed hereinabove with reference to bag 31 and hook and loop fasteners 32. The receptacle or bag 136 may include a plurality of tongues or flaps 137 provided with hook and loop fasteners (not shown) for removably attaching the bag to inside elements 112 and 114 defining aperture 130, as depicted in FIG. 11.

Sling 102 further comprises a pair of end bars or rods or PVC pipe sections 138 and 140 made of rigid material such as metal or hard polymer. Bars or rods 138 and 140 are connected to transverse edge elements 110*a* and 110*b* via straps, loops, hooks, rivets, or other fasteners 142, 144. Each bar or rod 138 and 140 is provided with coupling members 146 such as hooks, ties, chains, cables, etc., for suspending the sling 102 from frame 50 or other uprights or posts placed alongside a bed. Bars or rods 140 serve in part to maintain the extension or spread of sling 102, preventing collapse or bunching thereof.

In another embodiment, the transverse edge elements are extended by casings made of fabric and connected to transverse edge elements 110*a* and 110*b* via straps, loops, hooks, rivets, or other fasteners. The casings provide sleeves for placement of hollow plastic PVC pipes which are removable when washing the net. The PVC pipes keep the net flat and provide openings for a hammock strap to be inserted on each side to connect the sling to the tilting mechanism.

It is contemplated that the tilting is effectuated periodically. The user may be tilted to one side for a fixed period of time, say, fifteen minutes, and then the tilting mechanism elevates a low side and lowers a high side of the pelvic support to tilt the user in the opposite direction. The tilting mechanism can take any form suitable for the task, including electric linear servos, electric linear actuators, electric motors with rack-and-pinion or gear-and-pulley transmission trains, hydraulic or pneumatic lifts, etc. A controller (not shown) includes an automatic timer which is possibly programmable to enable the institution of multiple tilt angles for respective time periods. In addition, the program may allow for a periodic rocking from side to side.

It is to be noted that sling 102 may be used to support other parts of a user's body, for instance, the shoulder region, where bedsores are apt to arise. The main use, however, is in the pelvic region.

Figure 12:
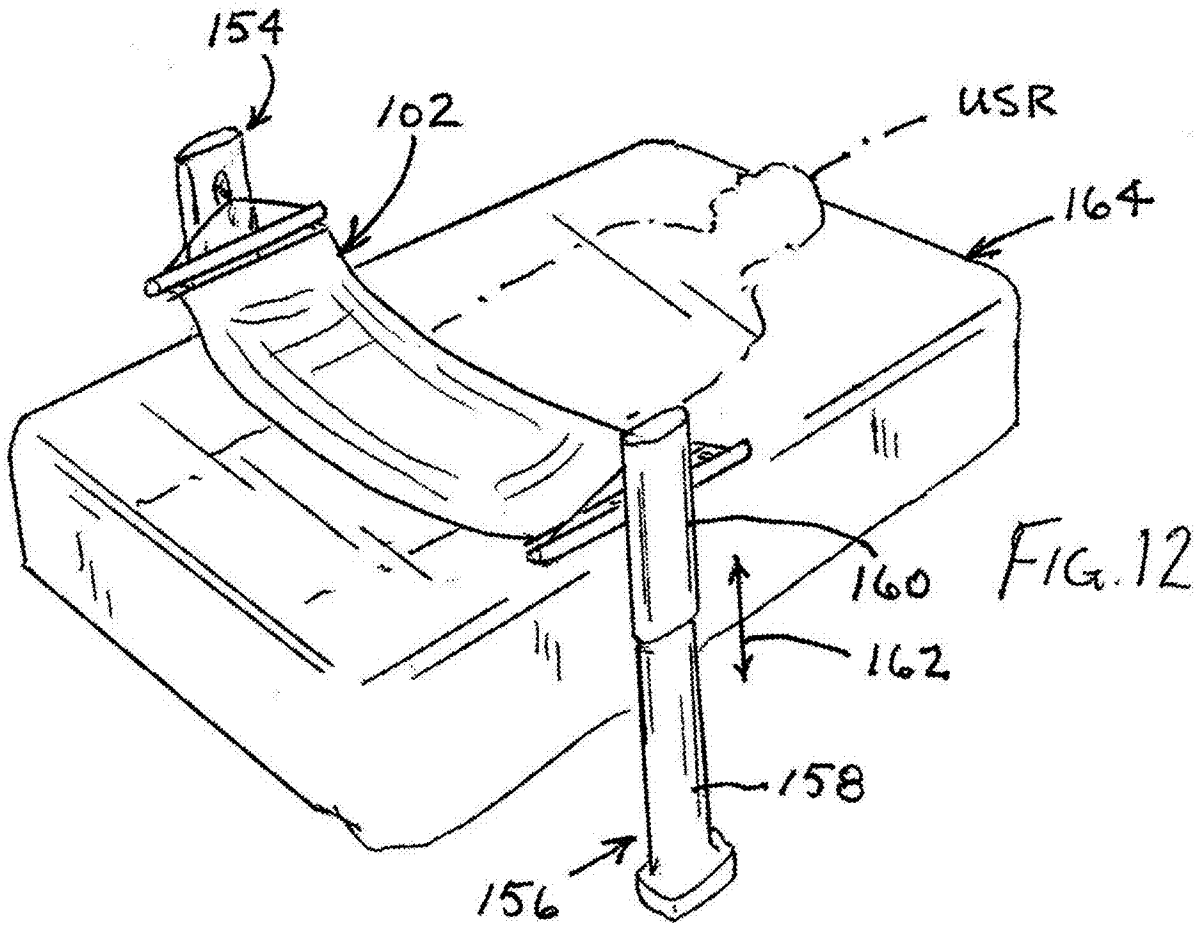
FIG. 12 is a schematic perspective view of a personal support system for a bed-confined person pursuant to the present invention.

FIG. 12 shows a patient support system including personal support member or sling 102. Support of sling 102 is suspended at opposite ends from two posts 154 and 156 which incorporate a tilting mechanism (such as electric linear servos or electric linear actuators) which is operatively connected to the sling and configured to shift the sling so as to rotate or tilt the pelvic region of a user USR. The two posts 154 and 156 are positioned on the floor on each long side of a mattress or bed 164 near a recessed portion (not shown) of the mattress. The pelvic support member or sling 102 is suspended between the two posts 154 and 156 so as to be aligned with the mattress and the user USR for support of the user's pelvic region. Each post includes a lower portion or base 158 and a top portion 160, where the top portion is slightly larger than lower portion 158 to allow the top portion to slide down over the base (as indicated by dual-headed arrow 162) for transporting a patient off bed or mattress 164. As discussed above, receptacle 136 (FIG. 11) is removably attachable to the sling 102 and disposable in part below aperture 130 (FIG. 11) for receiving eliminated waste of the user USR.

Set forth below is a table that shows a feature name or descriptive label and a related reference designation or number and indicates within which figures the feature appears. FIGS. 11 and 12 and their related reference numerals are omitted from the table.

| DESCRIPTION | NO. | FIG. NOS. |
|---|---|---|
| Mattress | 1 | 1A, 2, 3, 6, 9, 10 |
| Recessed portion of Mattress | 2 | 1A, 2, 3, 4, 5, 6, 9, 10 |
| Platform | 25 | 1A, 2, 5, 6, 7, 9, 10 |
| Chains | 26 | 1A, 2, 6, 7, 10 |
| Mini-alternating air mattresses | 27 | 1A, 2, 6 |
| Cable or Belt for pulley system | 28 | 2, 6, 10 |
| Electronic pulley system | 29 | 2, 6, 10 |
| Chain hook and loop | 30 | 1A, 2, 6, 10 |
| Plastic bag for waste elimination | 31 | 5, 8 |
| Fabric hooks (32) along ends of flaps or flanges (36) and at spaced locations on outside center of waste collection bag | 32 & 36 | 8 |
| Fabric hooks located on bottom of platform | 33 | 7 |
| Cut-out portion of platform | 34 | 1A, 2, 6, 7, 9, 10 |
| Frame | 50 | 1A, 2, 5 |
| Rectangular Base | 51 | 1A, 2, 5, 9, 10 |
| Two Side Walls | 52 | 1A, 2, 5, 6 |
| Rotating and waste elimination system | 100 | 1A, 1B, 1C, 2, 6 |
| Electronic Lift System | 200 | 1A, 1B, 1C |
| Two pairs of posts | 202 | 1A, 1B, 9 |
| Programmable electronically-controlled gear | 203 | 1A, 1B, 1C, 9 |
| Top of Rectangular Base | 204 | 1B, 1C |

What is claimed is:

1. A user rotation and waste elimination system utilizable with a mattress having a recessed area located at a user's pelvic region, said system being at least partially disposable in said recessed area, said system comprising:

(a) a plurality of posts;

(b) a pelvic support member suspended from said posts so as to be aligned with the mattress for support of the user's pelvic region, said pelvic support member having an aperture and at least one opening, said pelvic support member including a plurality of parts movable relative to one another to enable selective resizing and relocation of said at least one opening, thereby enabling an accommodation of bed sores of different sizes and different locations on the user for reducing incidence and severity thereof;

(c) a tilting mechanism incorporated into said posts which is operatively connected to said pelvic support member and configured to shift said pelvic support member so as to rotate or tilt the user's pelvic region; and (d) a receptacle removably attachable to said pelvic support member and disposable in part below said aperture for receiving eliminated waste of the user, said pelvic support member having a woven structure with said parts comprising weft elements and warp elements each slidaby connected at opposite ends to elongate edge or perimeter elements of a frame, each of said weft elements being shiftable in parallel relation throughout their lengths to others of said weft elements and each of said warp elements being shiftable in parallel relation throughout their lengths to others of said warp elements to enable adjustment in location and size of said at least one opening.

2. The system of claim 1 wherein at least some of said weft elements and warp elements are shiftable relative to others of said weft elements and warp elements to enable adjustment in size of said aperture.

3. The system of claim 1 wherein at least one of said posts is movable alternately upwardly and downwardly so as to tilt said pelvic support member alternately to opposites sides of the system.

4. The system of claim 3 wherein said posts are disposed on opposite sides of said mattress, said pelvic support member being suspended over or in the recessed area in the mattress.

5. The system of claim 1 wherein said tilting mechanism is operatively connected to said pelvic support member so as to selectively tilt said pelvic support member and accordingly the user's pelvic region from side to side, about an axis parallel to a longitudinal axis of the mattress.

6. The system of claim 1 wherein said receptacle carries a plurality of fasteners for removably attaching said receptacle to said pelvic support member.

7. The system of claim 6 wherein said fasteners are first fasteners and second fasteners which are located on said receptacle.

8. The system of claim 7 wherein said first fasteners and said second fasteners are taken from the group consisting of hook and loop fasteners.

9. The system of claim 6 wherein said receptacle is a bag.

10. The system of claim 9, wherein said bag is dimensioned to fit said aperture, said bag having flaps folded over a portion of said pelvic support member, said bag having first fasteners engaging with second fasteners to attach said bag to said pelvic support member.

11. The system of claim 1 wherein said recessed area or cavity is an elongated cavity extending transversely to said mattress, said pelvic support member having a width sufficiently small so that said pelvic support member is disposable in a support configuration in said recessed area or cavity.

12. The system of claim 11 wherein said recessed area or cavity extends across the entirety of said mattress from the left long side to the right long side of the mattress.

13. A user rotation and waste elimination system utilizable with a mattress having a recessed area located at a user's pelvic region, said system being at least partially disposable in said recessed area, said system comprising:

(a) a plurality of posts;

(b) a pelvic support member suspended from said posts so as to be aligned with the mattress for support of the user's pelvic region, said pelvic support member having an aperture and at least one opening, said pelvic support member including a plurality of parts movable relative to one another to enable selective resizing and relocation of said at least one opening, thereby enabling an accommodation of bed sores of different sizes and different locations on the user for reducing incidence and severity thereof;

(c) a tilting mechanism incorporated into said posts which is operatively connected to said pelvic support member and configured to shift said pelvic support member so as to rotate or tilt the user's pelvic region; and (d) a receptacle removably attachable to said pelvic support member and disposable in part below said aperture for receiving eliminated waste of the user, wherein said pelvic support member takes the form of a flexible sling, said sling comprising:

a frame including two longitudinal edge elements extending parallel to a long axis of the sling and defining long edges of said sling, said frame further including two transverse edge elements extending transversely to said long axis of the sling and defining short edges of said sling, each of said longitudinal edge elements being connected to each of said transverse edge elements;

a plurality of flexible longitudinal inside elements each slidably connected at opposite ends to said transverse edge elements;

a plurality of flexible transverse inside elements each slidably connected at opposite ends to said longitudinal edge elements, said longitudinal inside elements being disposable in mutually parallel relation throughout their lengths and at variable distances from each other, said transverse inside elements being disposable in mutually parallel relation throughout their lengths and at variable distances from each other.

14. The system of claim 13 wherein said transverse inside elements are primary transverse inside elements all having a first common length, further comprising a plurality of secondary transverse inside elements having a second common length shorter than said first common length, each of said secondary transverse inside elements being connected at one end to one of said longitudinal edge elements and at an opposite end to one of said longitudinal inside elements, wherein said aperture is edged or defined on opposite sides by two of said longitudinal inside elements connected to said secondary transverse inside elements at the respective said opposite end thereof.

15. The system of claim 13 wherein said receptacle is removably attachable to at least two inside elements taken from the group of said longitudinal inside elements and said transverse inside elements.

16. The system of claim 13 wherein said edge elements and said inside elements include fabric strips.

17. A method for managing human waste collection and disposal, comprising:

providing a pelvic support member suspended from a plurality of supports at least in part at a pelvic region of a user, said pelvic support member having an aperture, said pelvic support member having at least one additional opening;

providing a bag dimensioned to fit said aperture;

removably attaching said bag to said pelvic support member so that a pocket or receptacle portion of said bag is disposed below said aperture; and adjusting positions of parts of said pelvic support member in their entireties relative to each other to substantially change a geometric parameter of said aperture and/or at least one additional opening, said geometric parameter being taken from the group consisting of (a) size of said aperture and said opening and (b) location thereof relative to edges of said pelvic support member, said parts of said pelvic support member including longitudinally extending flexible elongate elements each slidably attached to transverse edge elements of said pelvic support member and further including transversely extending flexible elongate elements each slidably attached to longitudinal edge elements of said pelvic support member, the adjusting of said parts of said pelvic support member including sliding at least one of said flexible elongate elements along respective ones of said transverse edge elements and said longitudinal edge elements.

18. The method of claim 17 wherein the adjusting of said parts of said pelvic support member includes sliding a plurality of said flexible elongate elements along respective ones of said transverse edge elements and said longitudinal edge elements.

19. The method of claim 17 wherein the removable attaching of said bag to said pelvic support member includes folding flanges or flaps of said bag over and around a portion of said pelvic support member so that terminal portions of said flanges or flaps are located underneath said pelvic support member, the attaching of said bag to said pelvic support member further including coupling first fasteners to second fasteners.

20. A user rotation and waste elimination system utilizable with a mattress having a recessed area located at a user's pelvic region, said system being at least partially disposable in said recessed area, said system comprising:

(a) a plurality of posts;

(b) a pelvic support member suspended from said posts so as to be aligned with the mattress for support of the user's pelvic region, said pelvic support member having an aperture and at least one opening, said pelvic support member being configured to enable selective relocation of said opening, thereby enabling an accommodation of bed sores for reducing incidence and severity thereof;

(c) a tilting mechanism incorporated into said posts which is operatively connected to said pelvic support member and configured to shift said pelvic support member so as to rotate or tilt the user's pelvic region; and (d) a receptacle removably attachable to said pelvic support member and disposable in part below said aperture for receiving eliminated waste of the user, said pelvic support member taking the form of a flexible sling, said sling comprising:

a frame including two longitudinal edge elements extending parallel to a long axis of the sling and defining long edges of said sling, said frame further including two transverse edge elements extending transversely to said long axis of the sling and defining short edges of said sling, each of said longitudinal edge elements being connected to each of said transverse edge elements;

a plurality of flexible longitudinal inside elements each slidably connected at opposite ends to said transverse edge elements;

a plurality of flexible transverse inside elements each slidably connected at opposite ends to said longitudinal edge elements, each of said flexible longitudinal inside elements being interwoven with a respective plurality of said flexible transverse inside elements, said flexible longitudinal inside elements each being unattached to each of said respective plurality of said flexible transverse inside elements so as to be transversely shiftable relative to each of said respective plurality of said flexible transverse inside elements, each of said flexible transverse inside elements being interwoven with a respective plurality of said flexible longitudinal inside elements, said flexible transverse inside elements each being unattached to each of said respective plurality of said flexible longitudinal inside elements so as to be transversely shiftable relative to each of said respective plurality of said flexible longitudinal inside elements.

* * * * *